US005320500A

United States Patent [19]

Cholet

[11] Patent Number: 5,320,500

[45] Date of Patent: Jun. 14, 1994

[54] CONTINUOUS MIXING DEVICE, METHOD AND USE IN AN INSTALLATION FOR PUMPING A HIGH VISCOSITY FLUID

[75] Inventor: Henri Cholet, Le Pecq, France

[73] Assignee: Institut Francais Du Petrole, Rueil Malmaison Cedex, France

[21] Appl. No.: 942,765

[22] Filed: Sep. 10, 1992

[30] Foreign Application Priority Data

Sep. 10, 1991 [FR] France ..... 91 11297

[51] Int. Cl.[5] ..... F04B 17/00; F04B 35/00

[52] U.S. Cl. ..... 417/375; 417/405; 366/190

[58] Field of Search ..... 417/375, 405, 406, 409; 366/190, 325, 327, 329, 330

[56] References Cited

U.S. PATENT DOCUMENTS

| | | | |
|---|---|---|---|
| 4,292,011 | 9/1981 | Erickson | 417/405 |
| 4,610,547 | 9/1986 | Bennett | 366/270 |
| 4,712,984 | 12/1987 | Lepert | 417/406 |
| 4,838,704 | 6/1989 | Carver | 366/325 |
| 4,941,752 | 7/1990 | Yant et al. | 366/325 |
| 5,098,669 | 3/1992 | Kawanami et al. | 366/327 |
| 5,211,924 | 5/1993 | Lee et al. | 366/325 |

FOREIGN PATENT DOCUMENTS

| | | |
|---|---|---|
| 0253288 | 1/1988 | European Pat. Off. . |
| 0246943 | 11/1987 | France . |
| 89393 | 4/1972 | German Democratic Rep. . |

*Primary Examiner*—Richard A. Bertsch
*Assistant Examiner*—Alfred Basichas
*Attorney, Agent, or Firm*—Antonelli, Terry, Stout & Kraus

[57] ABSTRACT

The invention concerns a continuous mixing device (1) having a rotating shaft (4) fitted with blades (7, 7a). The mixture obtained at the outlet from the mixer results from admitting to the mixer a high-viscosity fluid (22) and at least one fluid of a lower viscosity. The mixing device is suitable for providing a mixture of lower viscosity compared with the most viscous fluid admitted at the inlet (2, 38) of the mixer. The invention provides a method of pumping a viscous fluid and use of the mixing device in an installation for pumping a high viscosity crude oil.

FIG. 1 to be published.

8 Claims, 4 Drawing Sheets

CONTINUOUS MIXING DEVICE, METHOD AND USE IN AN INSTALLATION FOR PUMPING A HIGH VISCOSITY FLUID

The invention concerns a continuous mixing device intended for mixing in particular high-viscosity crude oil with at least one other less viscous fluid in order to obtain a mixture with a much lower viscosity than the said crude oil, the mixture being more efficiently moved by pumping by conventional systems.

Current developments in petroleum production result in the exploitation of deposits of viscous oil, notably from wells having parts which are horizontal or steeply inclined with respect to the vertical passing through the deposit.

Where pumping by pipe is technically impossible or economically unprofitable, the use of rotary pumps, either centrifugal or positive displacement, has to be considered. But these pumps cannot function properly with high viscosity fluids.

Through the document U.S. Pat. No. 4,721,436, a method and installation for pumping viscous oil are known. This document describes the use of a centrifugal pump driven in rotation by a hydraulic turbine operated by injecting, from the surface, a driving fluid which is partly injected at the pump inlet in order to decrease the viscosity of the oil in the pump. This installation does not have any mixing device upstream of the pump. In this system the mixing takes place internally to the pump.

Through the patent application FR-2656035 a device is known for pumping a high-viscosity liquid, but the entire volume of the driving fluid is mixed with the crude oil. Moreover, this installation does not disclose any dynamic and continuous mixing device located upstream of the pump.

Advantageously the invention improves the prior art notably by the use of a mixing device separate from the pump and allowing suitable adjustment of the physical characteristics of the mixture conveyed to the pump inlet.

The object of the present invention therefore concerns a continuous mixing device including a body in which fluids flow between an inlet and outlet of the said body and at least two fluids with different viscosities entering through the said inlet. The device includes a rotating shaft having at least two blades and it is suitable for supplying, at the outlet from the body, a mixture of the said two fluids, the said mixture having a viscosity less than that of the most viscous fluid entering.

The profile of the blades can be such that, without any flow, the rotation of the blades produces a reaction force substantially parallel to the axis of rotation and directed in the same direction as the flow when the latter is established.

In another variant, the profile of the blades can be such that, without any flow, the rotation of the blades does not produce a reaction force of any notable magnitude parallel to the axis of rotation.

The device can include at least one assembly of three stages of blades, where each stage can consist of at least two blades having the same cylindrical volume generated by revolution. The stages can be offset by 120° with respect to the axis of the shaft and the cylindrical volumes generated by the revolution of each stage can be approximately adjacent.

The device can include four assemblies and the stage can have two blades disposed at 180°.

The shaft can be connected with respect to rotation to the shaft of a hydraulic pump and the outlet from the body can open into the inlet to the pump.

The pump can be rotated by a hydraulic motor, which can itself be rotated by the injection of a fluid under pressure.

Some of the pressurised fluid injected into the motor can be conveyed to the inlet of the said body.

The body of the device can advantageously include deflectors, the inner edges of which are approximately tangent to the volume of revolution of the blades.

The invention also concerns a method for pumping a high-viscosity fluid in which the fluid and at least one other fluid of lower viscosity are conveyed to the inlet of a mixing device according to the invention, the mixture at the outlet from the body being conveyed to the inlet of a pump.

In the method, some of the driving fluid can be conveyed to the inlet of the body, the said driving fluid being injected under pressure in order to rotate the hydraulic motor for driving the pump and device in rotation.

The invention also concerns the use of the mixing device according to the invention in an installation for pumping a high viscosity crude oil in a well incorporating a casing. The installation has a pipe for feeding the crude to the inlet of the device, a pipe connecting the outlet from the device to the inlet of a pump, a hydraulic motor for rotating the pump and the device, a pipe for injecting driving fluid connecting an injection installation on the surface to the motor, an outlet pipe from the pump conveying the mixture to the surface again and an outlet pipe from the motor conveying some of the driving fluid to the surface again, the remainder being conveyed to the inlet of the device through another pipe.

In a first variant of the use, a sealing means can be positioned between the crude feed pipe and the walls of the well defining an annular pipe communicating as far as the surface and the pumped mixture can travel to the surface through the annular pipe.

In a second variant, a single pipe can convey the part of the driving fluid and the mixture upwards and at the surface this pipe can communicate with an installation for separating notably the crude oil and the driving fluid.

In order to give a better understanding of the invention, a description will be given by way of an example which is in no way limitative, with reference to the accompanying figures, of one embodiment of a mixing device according to the invention, in the case of the exploitation of a high-viscosity oil deposit.

Figure 1:
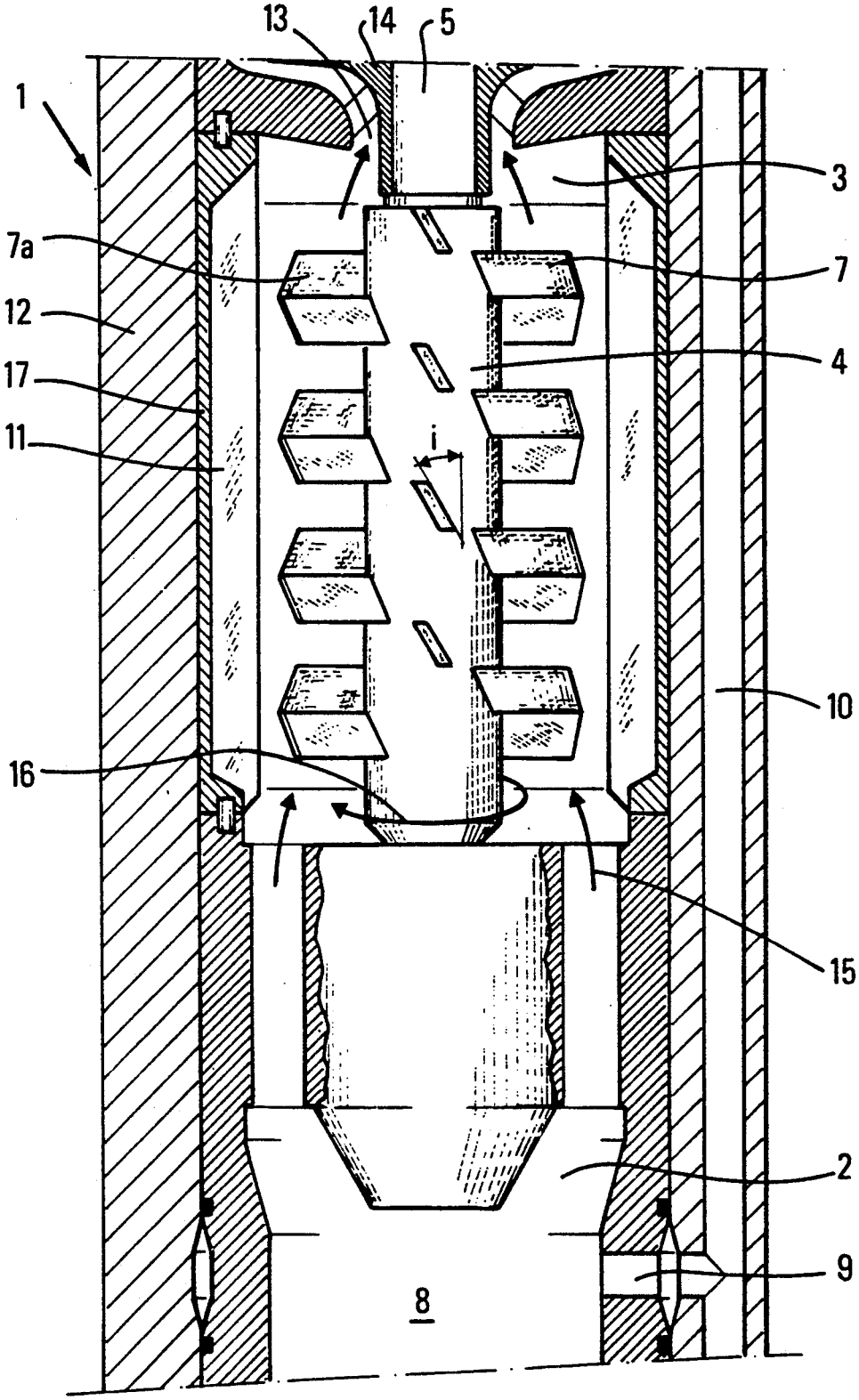
FIG. 1 shows a view of the mixing device in partial cross section.

In FIG. 1, the mixer 1 is incorporated in a housing 12 secured to the body of the pump, which is not shown in this figure. The pipe 8 connects the reserve of crude oil to the inlet 2 of the body 17 of the mixer 1. An orifice 9 connects the duct 10 to the inlet 2 of the mixer. The duct 10 is notably located in the wall of the housing 12.

The outlet 3 from the body 17 of the mixer 1 communicates with the inlet 13 of the centrifugal pump, the first wheel of which is given the reference number 14.

A cylindrical shaft 4 is guided at both ends by the bearing 6 and a means 5 of connection to the shaft of the centrifugal pump.

The shaft 4 has pairs of blades 7 and 7*a*, symmetrical with respect to the axis of the shaft 4 and located in the same cross section. In this embodiment, the shaft is fitted with twelve pairs of blades disposed over the length of the shaft so that the top edge of a blade is substantially in the same cross section as the bottom edge of the adjacent blade. Thus each revolution volume generated by the rotation of a pair of blades is substantially adjacent to the following one.

The blades are inclined at an acute angle i with respect to the axis of the shaft oriented in the direction of flow, that is to say in the direction of the arrow 15, the direction of rotation of the shaft being indicated by the arrow 16. This mode of orientation of the blades relative to the direction of rotation of the shaft and in the direction of flow of the fluids in the mixer produces a reaction force on the shaft in the same direction as the flow. This force is the axial component of the resultant of the reaction forces on each blade. In fact, the rotation of these helixes formed by all the blades has a tendency to repel the fluid in the opposite direction to its flow. In this profile arrangement, the mixer can be compared to a repulsion screw. This arrangement assists the action of stirring the fluids in the mixer in order to obtain a homogeneous mixture.

It would not be a departure from the scope of this invention if the cross section of the blades were not inclined as above. In certain cases of simplified use, the blades can in particular be flat and their width disposed parallel to the axis of the shaft, that is to say the angle i is zero. The blades can also have a substantially cylindrical shape. In a more general sense, it could be said that in this embodiment the mixer will neither repel nor attract with respect to the flow. The mode of action is then close to an action of shearing the fluid stream flowing through.

In none of the embodiments can the blades of the continuous mixer have an action bringing about an acceleration of the flow, like an attraction screw or a centrifugal pump wheel. In other words, the mixer of our invention is completely different from a compression element, whether this is a pump element, a booster element or a priming element. On the contrary, the mixer of our invention brings about a pressure drop, generally minimal but nevertheless perceptible.

The pairs of blades are distributed on the circumference of the shaft with an angular offset of 120°. Thus the fourth blade has the same angular position as the first one, thus defining an assembly of three pairs of blades. The embodiment shown therefore has four of these assemblies.

Without departing from the scope of this invention, the number or arrangement of the blades could be different. In fact, depending on the nature of the fluids and their flow rate in the mixer, the number of blades could be increased or decreased, and more than two blades could even be disposed in the same cross section. In this case, they will be distributed evenly on the circumference of the shaft. Moreover, the value of the angle i can be variable but equal to or less than 90°, having regard to the references indicated above.

Figure 2:
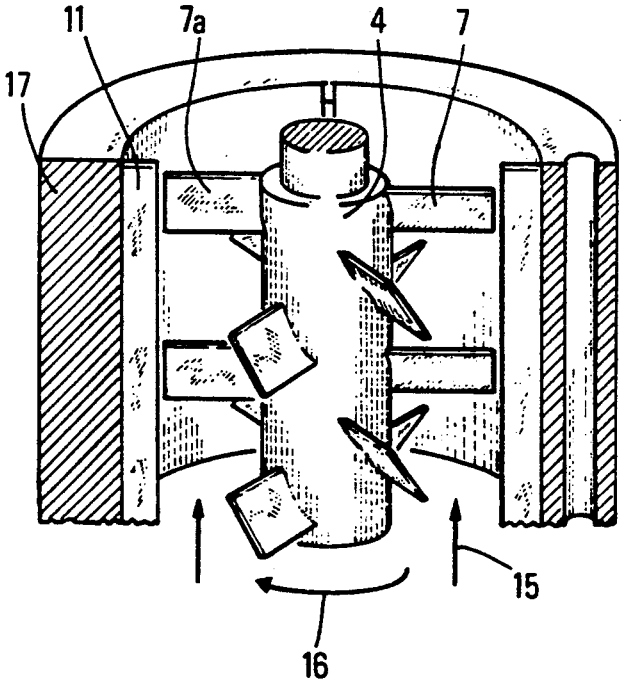
FIG. 2 shows a perspective view of the rotating shaft of the mixer enabling the respective arrangements of the blades to be described better.

FIG. 2 shows in partial perspective view the arrangement thus obtained in the preferred embodiment.

The body 17 of the mixer has deflectors 11 disposed in accordance with the generatrices of the internal cylindrical volume of the body. This embodiment has four deflectors distributed at 90°. The deflectors can be produced in many diverse ways, their principal role being to redirect the fluid stream by assisting the turbulences created by the blades whilst allowing the fluid to flow between the inlet and outlet.

Figure 3:
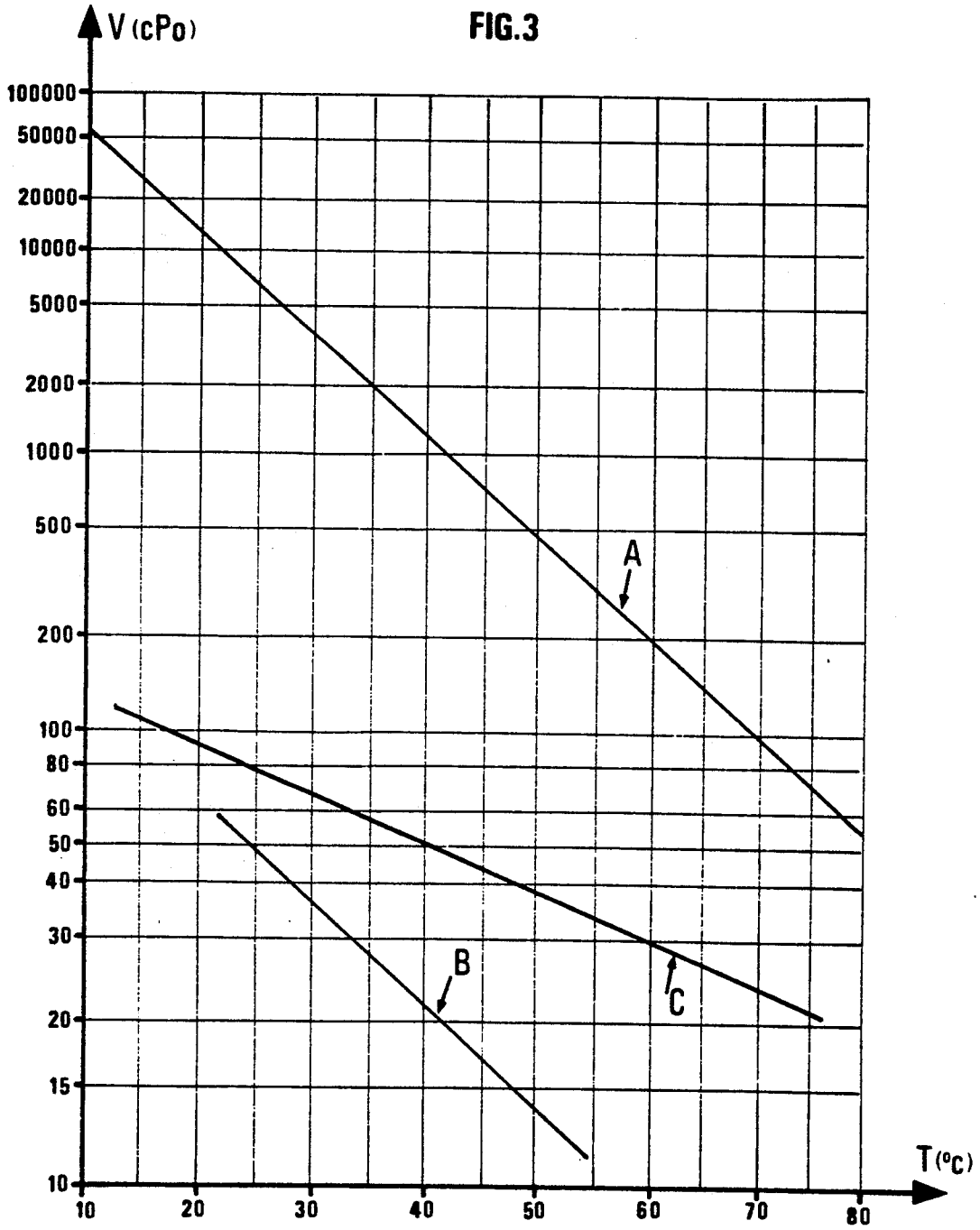
FIG. 3 shows a graph giving the viscosity of the oil and of the mixture obtained as a function of temperature.

In FIG. 3, three curves A, B and C have been traced, giving the viscosity variation in centipoise against temperature in degrees celsius.

Curve A relates to an anhydrous heavy crude oil.

Curve B gives the viscosity of an emulsion, 60% of which is the heavy oil of curve A and 40% water, the whole having passed through the mixing device of the invention at a flow rate of 2500 l/hour and at a speed of rotation of the mixer of 3000 rev/min.

Curve C shows the viscosity of a mixture obtained in a receptacle from the same proportion of crude oil and water.

The efficiency of the dynamic mixer compared with a static mixer (curve C) will be noted.

Figure 4:
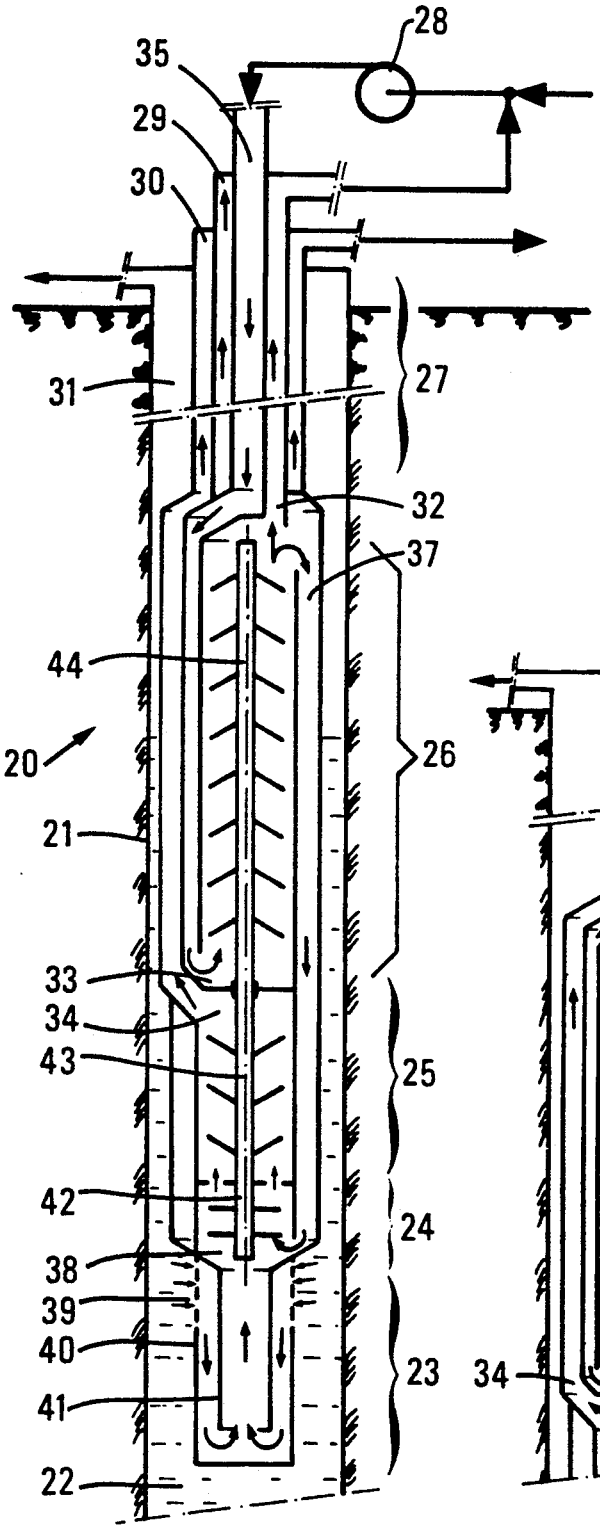
FIG. 4 shows a diagram of an installation for pumping crude oil including the mixture.

FIG. 4 shows a pumping installation lowered into a well 20, in general lined with a casing 21. The well is in communication with a deposit of viscous oil. This oil flows into the well. The installation pump is immersed in the oil 22 at a suitable depth depending in particular on the characteristics of the deposit, the configuration of the completion and the static and dynamic level of the effluent.

The bottom part of the installation is broken down as follows:

23 indicates the crude oil feed pipe,
24 indicates the continuous mixer,
25 indicates the pump,
26 indicates the hydraulic motor driving the pump and mixer.

The top part 27 consists of concentric tubes, assembled as far as the surface, where there are located in particular an installation 28 for injecting the driving fluid, an outlet from a conduit 29 for collecting some of the driving fluid, an outlet from a conduit 30 for collecting the compressed mixture, an outlet from a degassing conduit 31 and the start of the conduit 35 for injecting the driving fluid.

The conduit 35 connects the injection installation 28 to the inlet 33 of the hydraulic motor.

The conduit 31 is an annular conduit defined by the well and the outside of the tubes and of the housings of the pumping installation. This conduit directly connects the crude oil reserve to the surface and makes it possible to collect the gas at the surface whilst allowing the oil to degas naturally. The more the fluid 22 is degassed, the better will be the efficiency of the pumping installation.

The conduit 30 connects the outlet from the pump 34 to the surface.

The conduit 29 connects the outlet 32 of the hydraulic motor.

A conduit 37 connects the outlet 32 from the motor to the inlet 32 of the mixer 24.

The feed conduit 23 has two concentric tubes 40 and 41 forming baffles in order to assist the degassing of the crude. The latter enters the conduit through the perforations 39, passes into the annulus of the tubes 40 and 41 and then goes up the tube 41 to arrive at the inlet 38 to the mixer.

The rotating shafts 42, 43 and 44 respectively of the mixer, pump and motor are connected with respect to rotation, that is to say the rotation of the motor shaft causes the rotation of the pump shaft and of the mixer shaft. It would not be departing from the scope of this invention if these three shafts were not identical and if their speeds were not identical.

The motor 26 can be of the turbine or positive displacement type, for example according to the Moineau principle. The driving fluid can flow in the motor from bottom to top or vice versa.

The pump can be of the single or multi-stage centrifuge type or of the positive displacement type, for example according to the Moineau principle.

As an illustration, the dimensions of the triple concentric completion lowered into the lining 21 made from 9⅝" casing can be: 7" casing or tubing for the conduit 30, 4½" or 5" tubing for the conduit 29 and 2" or 2⅞" tubing for the conduit 35.

Figure 5:
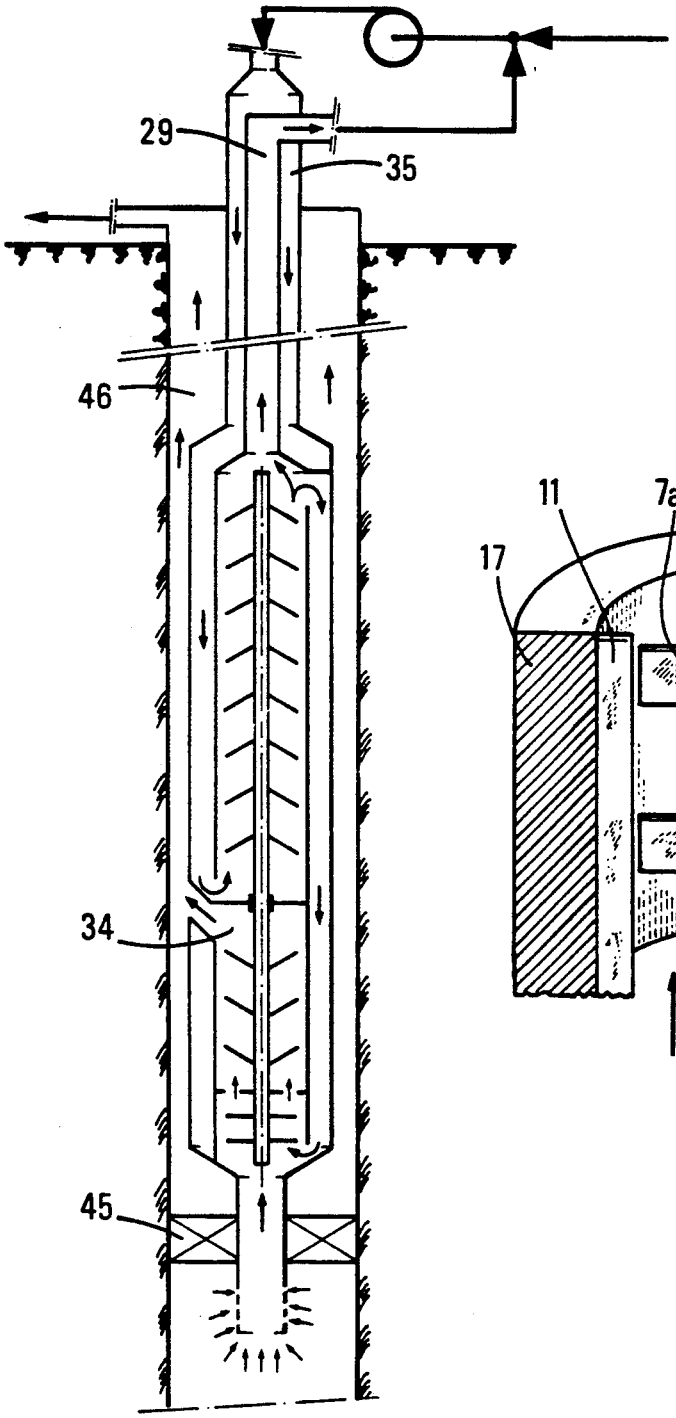
FIG. 5 shows a variant of the preceding pumping installation.

In a first variant shown in FIG. 5, the installation is simplified from the point of view of the number of conduits compared with the preferred embodiment of FIG. 4, in which three concentric conduits 30, 29, 35 are used in the well 20, that is to say a triple completion. In fact, in cases where the crude oil does not degas, it is possible to install, on the lower body of the pumping assembly, a packer type sealing element 45 between the oil supply conduit and the walls of the well. This packer isolates the reservoir zone and allows the use of the annular conduit 46 above the said packer for raising the mixture from the outlet 34 of the pump as far as the surface. The completion then has two tubes 29 and 35 for respectively raising some of the driving fluid and injecting driving fluid.

Figure 6:
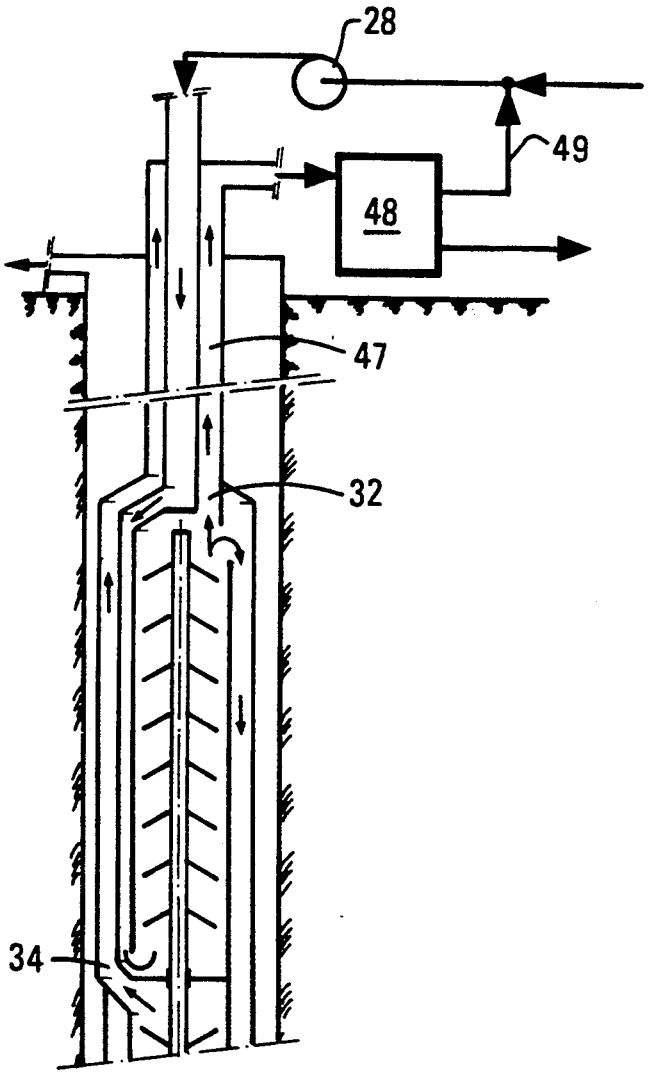
FIG. 6 shows another variant of the pumping installation.

A second variant of the pumping installation is shown in FIG. 6. In this case the pumped mixture and the portion of the driving fluid are pumped up together. The outlets 32 and 34 respectively from the motor and pump communicate in a single conduit 47. This conduit is connected at the surface to an installation 48 suitable for separating the crude oil, driving fluid and other fluids in the mixture if these are not the driving fluid. At the outlet from the separation installation, a conduit 49 recovers the driving fluid so that it can be recycled in the injection installation 28.

The conduits 29, 30 and 35 can be other than concentric, and indeed the prior art included multiple non-concentric completions, ie using parallel tubes in the well 20.

Without departing from the scope of this invention, the lower-viscosity fluid admitted to the mixer inlet through the orifice 9 could be different from the driving fluid used for driving the pumping installation. In addition this lower viscosity fluid may have several constituents suitable for assisting the mixing. In this case another separate feed line connected to the surface could be used.

The fluid or fluids mixed with the high-viscosity fluid can be of mineral or organic origin. The mixture obtained by the mixer according to the invention will be an emulsion and/or dilution.

The proportions of the constituents of the mixture can be variable according to the characteristics of the deposit and the nature of the fluids in situ. In the case of the installation of FIG. 4 and its variants in FIGS. 5 and 6, means for regulating the flow of fluid injected at the inlet to the mixer are notably located between the outlet from the motor and the conduit 10 or 37.

Without departing from the scope of the invention, the well could have an inclined portion and could even be close to the horizontal. The pumping installation is then in general lowered into a highly inclined part of the well.

I claim:

1. An installation for pumping a high viscosity crude oil in a wall incorporating a casing, wherein said installation comprises a continuous mixing device comprising a body in which fluids flow between an inlet and an outlet of said body and at least two fluids with different viscosities enter through said inlet, a rotating shaft having at least two blades and being suitable for supplying at the outlet from said body, a mixture of said two fluids, said mixture having viscosity less than that of the most viscous fluid entering said inlet; and a hydraulic pump connected to said body via said outlet and wherein said installation has a pipe for feeding the crude oil to the inlet of said mixing device, a pipe connecting the outlet from said mixing device to an inlet of the pump, a hydraulic motor for rotating the pump and the rotating shaft of said mixing device, a pipe for injecting driving fluid connecting an injection installation on the surface to the motor, an outlet pipe from the pump conveying the mixture to the surface again and an outlet pipe from the motor conveying some of the driving fluid to the surface again, the remainder being conveyed to the inlet of said mixing device through another pipe.

2. An installation according to claim 1, wherein the profile of the blades is such that, without any flow of said fluids, the rotation of the blades produces a reaction force substantially parallel to an axis of rotation of said shaft and directed in a same direction as the flow when the flow is established.

3. An installation according to claim 1, wherein the profile of the blades is such that, without any flow of said fluids, the rotation of blades does not produce a reaction force of any notable magnitude parallel to the axis of rotation.

4. An installation according to claim 1, wherein said mixing device has at least one assembly of three stages of blades, each stage consisting of at least tow blades having the same cylindrical volume generated by revolution, said stages are offset by 120° with respect to the axis of said shaft and cylindrical volumes generated by the revolution of each stage of blades are approximately adjacent.

5. An installation according to claim 4, wherein a stage comprises two blades disposed at 180° on the shaft and said mixing device has four of said assemblies.

6. An installation according to claim 1, said installation further comprising a sealing means positioned between said crude oil feed pipe and walls of the well defining an annular conduit communicating as far as the surface and the pump mixture is raised to the surface through said annular conduit.

7. An installation according to claim 1, wherein said installation further comprises a single conduit for raising said part of the driving fluid and said mixture and at the surface this conduit communicates with an installation unit for separating the crude oil and the driving fluid.

8. An installation according to claim 1, wherein said body of the mixing device has deflectors, the inner edges of which are substantially tangent to the volume of revolution of the blades.

* * * * *